US005971749A

United States Patent [19]

Chen

[11] Patent Number: 5,971,749

[45] Date of Patent: Oct. 26, 1999

[54] SAFETY DISPOSABLE LIGHTER

[76] Inventor: Peter Chen, 16134 E. Ridge View, La Mirada, Calif. 90638

[21] Appl. No.: 09/200,154

[22] Filed: Nov. 25, 1998

[51] Int. Cl.[6] ..... F23Q 2/46

[52] U.S. Cl. ..... 431/153; 431/277

[58] Field of Search ..... 431/153, 276, 431/277

[56] References Cited

U.S. PATENT DOCUMENTS

| | | | |
|---|---|---|---|
| 5,096,414 | 3/1992 | Zellweger | 431/153 |
| 5,547,370 | 8/1996 | Hwang | 431/277 |
| 5,868,561 | 2/1999 | Rogelet | 431/277 |

FOREIGN PATENT DOCUMENTS

| | | | |
|---|---|---|---|
| 2499680 | 8/1982 | France | 431/153 |

*Primary Examiner*—Ira S. Lazarus
*Assistant Examiner*—Sara Clarke
*Attorney, Agent, or Firm*—Raymond Y. Chan; David and Raymond

[57] ABSTRACT

A safety disposable lighter includes an ignition means which includes a striker wheel has an axial polygonal driven hole provided therethrough, a wheel axle rotatably mounting between two supporting walls of a supporting frame and having an enlarged central engaging disc fittedly mounted at a center position of the driven hole of the striker wheel, and two driving wheels each having a polygonal driving disc integrally and coaxially protruded at an inner side thereof. Each of the driving wheels has an axial hole having a diameter larger than that of the wheel axle. Between the two supporting walls, the two driving wheels are rotatably mounted around two ends of the wheel axle respectively and the two driving discs are respectively inserted into two end portions of the driven hole, wherein each of the driving wheels has a diameter larger than a diameter of the striker wheel, and the polygonal driving disc of each driving wheel has a size smaller than the polygonal driven hole, so that the two driving wheels can normally free to rotate about the wheel axle unless a relatively strong depressing force is applied by an adult's finger to the two driving wheels to retain the two polygonal driving discs of the two driving wheels engaging with two end portions of the polygonal driven hole of the striker wheel.

10 Claims, 3 Drawing Sheets

SAFETY DISPOSABLE LIGHTER

FIELD OF THE PRESENT INVENTION

The present invention relates to disposable lighter, and more particularly to a safety disposable lighter that can prevent children under 4 years old from igniting the lighter so as to guarantee the safety of children.

BACKGROUND OF TH PRESENT INVENTION

For protecting children, starting from 1993 to 1994, the U.S. Consumer Product Safety Commission declared that the traditional disposable lighter should not be sold. Moreover, the U.S. Consumer Product Safety Commission imposed an important regulation that "Child below 4 years old cannot light the lighter".

Accordingly, various kinds of disposable lighters having switching mechanisms for rendering the lighters child resistant have been developed. Such switching mechanisms provide a switch member requiring the adult user to turn it on before permitting an operating lever to be depressed to lift a gas pipe to open a gas release valve while a spark is generated by simultaneous rotation of a striker wheel in engagement with a flint. However, such conventional gas lighters with switching mechanisms also bear the drawbacks as follows:

1. Numerous additional elements of the switching mechanism are required to incorporate with the traditional disposable lighter for ensuring the safety thereof. Such a costly switching mechanism not only increases the cost of the disposable lighter, but also increases the manufacturing procedures of the disposable lighter.

2. During the igniting operation of the gas lighter, initially, an additional step of turning the switch member of the switching mechanism to release the locking of the operating lever is needed for enabling the depressing of the operating lever to lift the gas pipe to open the gas release valve, which complicates the manipulation of ignition.

As mentioned above, most disposable lighters incorporated a switching mechanism to lock the gas lever or the spark wheel to prevent children from starting a fire. However, children are excellent in learning. Some smart or brilliant children may learn from an adult to release such switching mechanism and ignite the fire. Accordingly, it is not a wise way of trying to lock the spark wheel or the gas lever. In fact, the normal pressure of a thumb of a 4 years old child is about 1 kg. The maximum pressure of the thumb is not over 1.5 kg. The normal procedure for lighting the disposable lighter is to press the side and spark wheel so as to spark the flint and light a fire. At the same time, the lever must be pressed down to release the gas (the normal pressure to release gas is 0.5 to 1 kg) Therefore, a better way to prevent the children from igniting a lighter is to design a safety lighter that the child below 4 years old does not has the enough strength to ignite it.

A typical example, disclosed in a U.S. Pat. No. 5,096,414 owned by Zellweger, comprises a striker wheel acting on a spark stone. The striker wheel is disposed between two plates of greater diameter than and freely rotatable with respect to the wheel. Actuation of this lighter is obtained by friction thanks to the deformation of the pulp of the thumb of the user. Therefore, the striker wheel may not be driven by a child, as the pulp of the finger of a child is not sufficiently thick.

U.S. Pat. No. 5,547,370, owned by Hwang, is a further improvement of Zellweger's patent. Similar to Zellweger's patent Hwang's patent also includes a wheel axle mounted between two upright supports at the top of a butane wheel, two driving wheels mounted around the wheel axle between the upright supports, and a striker wheel fixedly mounted around the wheel axle and disposed in contact with a spring-supported flint below the striker wheel. The striker wheel is turned by the driving wheels through the wheel axle to strike the spring-supported flint in producing sparks. The improvement is that the wheel axle is made of polygonal cross section, having two round rods at two opposite ends loosely inserted into a respective axle hole on each upright support so as to ensure a better connection between the striker wheel and the wheel axle.

However, Zellweger's and Hwang's patents still bear the following drawbacks:

1. The assembly cost is higher because special care and measurement must be applied to ensure the striker wheel is located in a center position of the wheel axle. Especially in Hwang's patent, the central polygonal hole of the striker wheel must be exactly equal to the size of the polygonal wheel axle. If it is too small, it is impossible to insert the wheel axle therethrough. If it is too big, the striker wheel may not be firmly held in center position. How to punch in the polygonal wheel axle through the polygonal hole of the striker wheel and how to ensure the striker wheel located in the center position of the wheel axle become the headaches of Hwang's patent.

2. Accordingly, a slight clearance would exist between the striker wheel and the wheel axle so as to facilitate insertion of the polygonal wheel axle through the central polygonal hole of the striker wheel. Normally, the rotation of the wheel axle can drive the striker wheel to rotate with no problem. However, the striker wheel may gradually move aside after using for a period of time. If such condition happens, the center of the striker wheel will not remain aligning with the flint properly, that may unavoidably affect the ignition of the lighter. Malfunction may also occur. The tip of the flint may get stuck between the driving wheel and the striker wheel.

3. In view of Hwang's patent, the driving wheels are not equipped to directly drive the striker wheel to rotate. In fact, the driving wheels must first to drive the wheel axle to rotate and then the striker wheel is driven to rotate by the rotating wheel axle. Since the size of the wheel axle is much smaller than the striker wheel, therefore even some adult will find it difficult to ignite the lighter.

SUMMARY OF THE PRESENT INVENTION

It is thus a first object of the present invention to provide a safety disposable lighter in which the striker wheel can be properly and tightly supported by the wheel axle at a position on top of the flint.

A further object of the present invention is to provide a safety disposable lighter in which the wheel axle has an enlarged engaging disc positioned at a center position thereof for easily and fittedly engaged with the striker wheel. Therefore, the manufacturing cost and procedures of the present invention remain as usual and do not need to be increased as the conventional safety lighters did.

Yet another object of the present invention is to provide a safety disposable lighter in which the striker wheel is directly driven by the driving wheels. The wheel axle is simply for supporting the striker wheel.

Still another object of the present invention is to provide a safety disposable lighter, which does not require incorporating with any additional part or element in order to provide safety feature for preventing the children to ignite the lighter.

Accordingly, in order to accomplish the above objects, the present invention provides a safety disposable lighter which comprises a supporting frame and an ignition means. The supporting frame is disposed on a gas reservoir having a valve which is actuated by a gas lever pivotally mounted on the supporting frame for releasing gas therefrom. The ignition means comprises a flint supported by a resilient element, and a striker wheel which is rotatably mounted on the supporting frame. The striker wheel has an outer striking surface in contact with the flint. The flint is retained urging against the striking surface of the striker wheel by means of the resilient element for generating spark directed towards the valve when the striking surface is driven to rotate against the flint. The supporting frame comprises a pair of supporting walls protruded on opposite sides of the gas lever from a frame cover sealedly secured onto the gas reservoir, wherein the striker wheel is rotatably mounted between the two supporting walls.

The characteristic improvement of the present invention is the ignition means, wherein the striker wheel has an axial polygonal driven hole provided therethrough. The ignition means further comprises a wheel axle rotatably mounted between the two supporting walls. The wheel axle has an enlarged central engaging disc fittedly mounted at a center position of driven hole of the striker wheel so as to firmly support the striker wheel on top of the flint between the two supporting walls. The ignition means further comprises two driving wheels each having a polygonal driving disc integrally and coaxially protruded at an inner side thereof. Each of the driving wheels has an axial hole having a diameter larger than that of the wheel axle. Between the two supporting walls, the two driving wheels are rotatably mounted around two ends of the wheel axle respectively and the two driving discs are respectively inserted into two end portions of the driven hole of the striker wheel, wherein each of the driving wheels has a diameter larger than a diameter of the striker wheel, and the polygonal driving disc of each driving wheel has a size smaller than the polygonal driven hole, so that the two driving wheels can normally free to rotate about the wheel axle unless a relatively strong depressing force is applied by an adult's finger to the two driving wheels to retain the two polygonal driving discs of the two driving wheels engaging with two end portions of the polygonal driven hole of the striker wheel, so that by rotating the two driving wheels with the depressing force mentioned above, the two driving discs of the driving wheels can directly drive the striker wheel to rotate and strike against the flint to produce sparks towards the valve to ignite the safety disposable lighter of the present invention.

DETAILED DESCRIPTION OF THE PREFERRED EMBODIMENT

Figure 1:
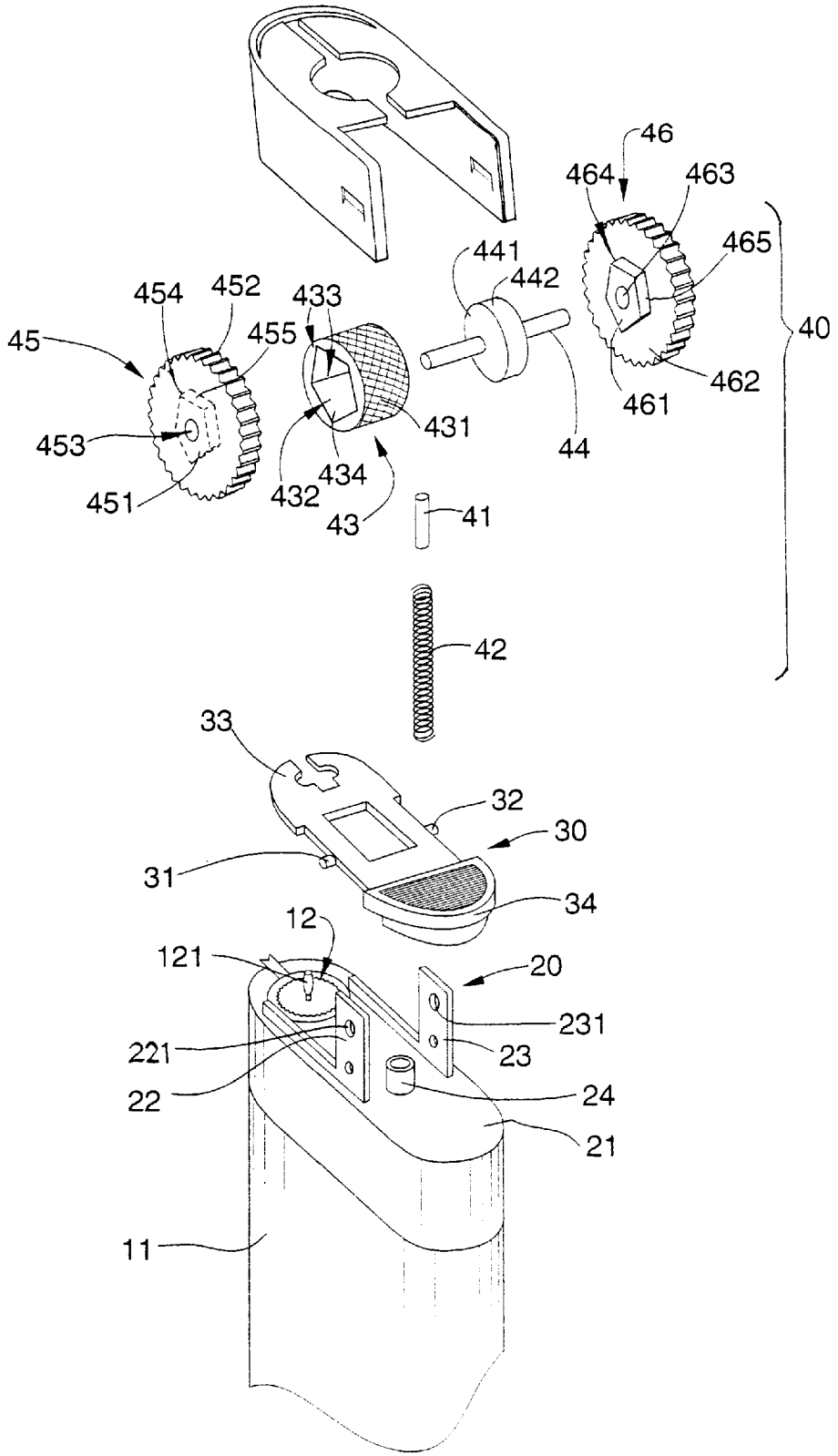
FIG. 1 is an exploded perspective view of a safety disposable lighter according to a preferred embodiment of the present invention.
Figure 2:
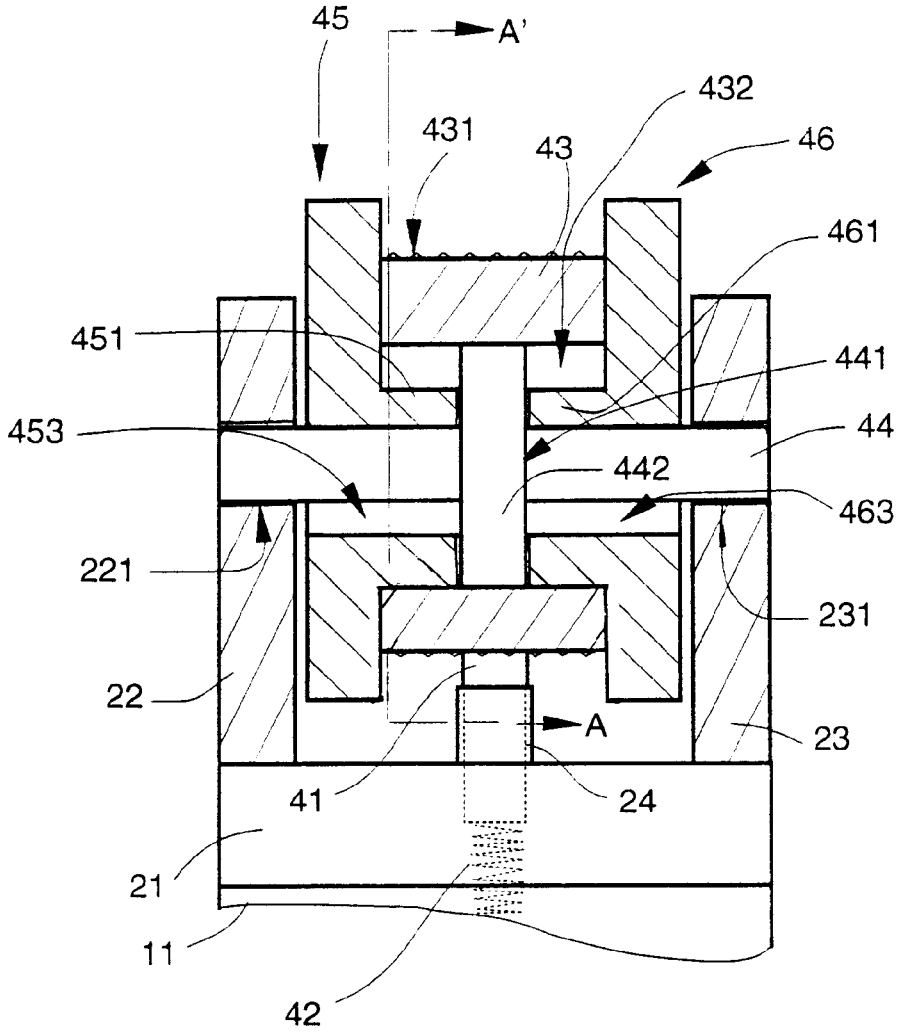
FIG. 2 is a partial sectional end view of the safety disposable lighter according to the above preferred embodiment of the present invention.
Figure 3:
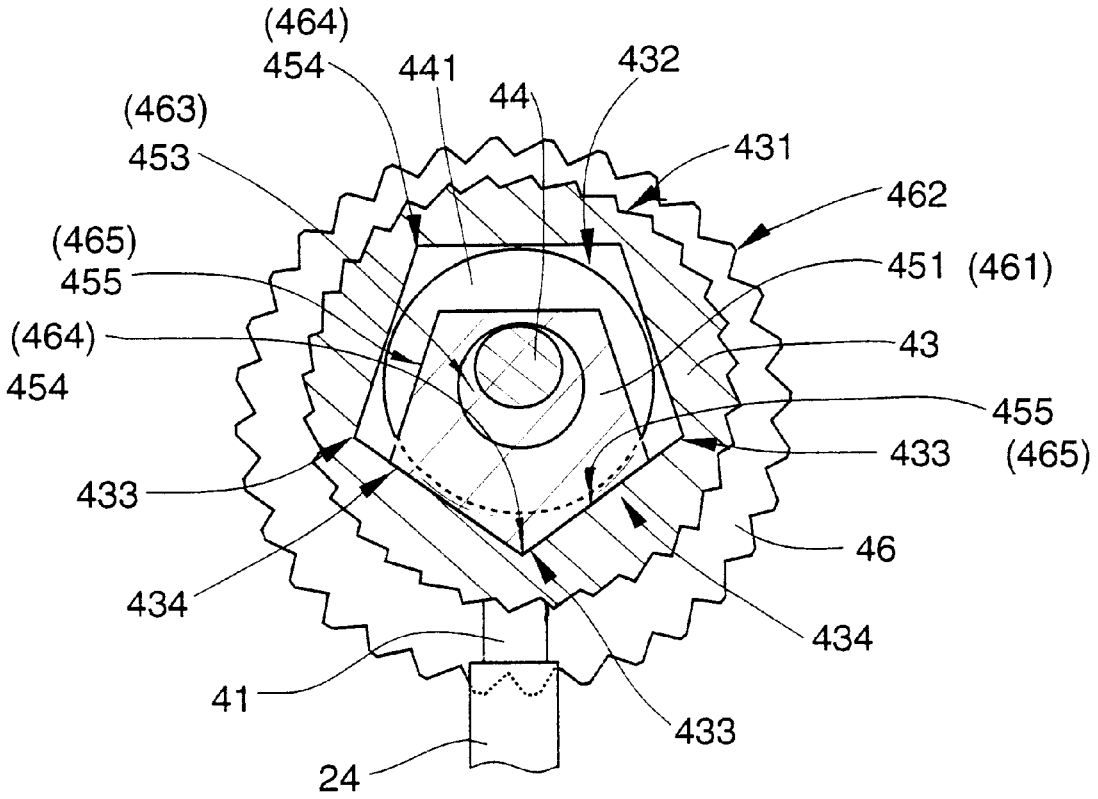
FIG. 3 is a partial sectional side view, along sectional line A–A' in FIG. 2, illustrating the relationship between the driving wheel, the wheel axle and the striker wheel of the safety disposable lighter according to the above preferred embodiment of the present invention.

Referring to FIGS. 1, 2 and 3 of the drawings, a safety disposable lighter of the present invention comprises a supporting frame 20 and an ignition means 40. The supporting frame 20 is disposed on a gas reservoir 11 having a valve 12 which is actuated by a gas lever 30 pivotally mounted on the supporting frame 20 for releasing gas therefrom. The supporting frame 20 is protruded from a frame cover 21 sealedly secured onto the gas reservoir 11 filled with liquid petroleum gas such as butane therein.

The supporting frame 20 comprises a pair of supporting walls 22, 23 protruded on opposite sides of the gas lever 30. The gas lever 30 is pivotally mounted between the two supporting walls 22, 23 by means of two pivots 31, 32 protruded from two opposite sides of the gas lever 30. The gas lever 30 has a front end 33 extending frontward to engage with a nozzle 121 of the gas valve 12 and a depressible rear end 34 extending rearwards of the frame cover 21 for enabling the depressing of the depressible rear end 34 for lifting up the gas nozzle 121 to open the gas valve 12. Each of the supporting walls 22, 23 has a circular supporting hole 221, 231 provided thereon.

The ignition means 40 comprises a flint 41 supported by a resilient element 42 and a striker wheel 43 which is rotatably mounted on the supporting frame 20. The striker wheel 43 has an outer striking surface 431 in contact with the flint 41. The flint 41 and the resilient element 42 are received in a flint housing 24 which is underneath the striker wheel 43 and provided on the frame cover 21 between the two supporting walls 22, 23. An upper portion of the flint 41 must be retained exposing outside the flint housing 24 and urging against the striking surface 431 of the striker wheel 43 by means of the resilient element 42 for generating sparks directed towards the valve 12 when the striking surface 431 is driven to rotate against the flint 41.

The characteristic improvement of the present invention is the ignition means 40, wherein the striker wheel 43 has an axial polygonal driven hole 432 provided therethrough. According to the preferred embodiment of the present invention, the driven hole 432 of the striker wheel 43 is preferred to have a pentagonal shaped defining five engaging corner edges 433 and five driven surfaces 434. The ignition means 40 further comprises a wheel axle 44 having two ends rotatably mounted at the two supporting holes 221, 231 of the two supporting walls 22, 23 respectively.

The wheel axle 44 has an enlarged central engaging disc 441 which is in circular shape and fittedly mounted at a center position of driven hole 432 of the striker wheel 43 so as to firmly support the striker wheel 43 on top of the flint 42 between the two supporting walls 22, 23. According to the present embodiment, a diameter of the engaging disc 441 is equal to or preferably slightly larger than a distance between two opposing driven surfaces 434 of the pentagonal driven hole 432, so that a circumferential surface 442 of the engaging disc 441 would be pressed against the five driven surfaces 434 of the driven hole 432 of the striker wheel 43 so as to firmly and rotatably support the striker wheel 43 between the two supporting walls 22, 23 by means of the wheel axle 44.

The ignition means 40 further comprises a pair of driving wheel 45, 46. Each of the driving wheels 45, 46 has a polygonal driving disc 451, 461 integrally and coaxially protruded at an inner side 452, 462 thereof. With respect to the pentagonal driven hole 432 of the striker wheel 43 according to the present embodiment, the two driving disc 451, 461 are also in pentagonal shape and each defines five engaging corners 454, 464 and five driving surfaces 455, 465. Each of the driving wheels 45, 46 has an axial hole 453, 463 having a diameter larger than that of the wheel axle 44.

Moreover, each of the driving wheels 45, 46 has a diameter larger than a diameter of the striker wheel 43, and the driving disc 451, 461 of each driving wheel 45, 46 has a size smaller than the size of the driven hole 432 of the striker wheel 43 for enabling the two driving discs 451, 461 free to rotate within the driven hole 432.

Between the two supporting walls 22, 23, the two driving wheels 45, 46 are rotatably mounted around two ends of the wheel axle 44 respectively, and the two driving discs 451, 461 of the two driving wheels 45, 46 are respectively inserted into the two ends of the driven hole 432 of the striker wheel 43.

As mentioned above, since the size of the driven hole 432 is made larger than the two driving discs 451, 461 and the diameter of each of the two axial holes 453, 463 is also made larger than the wheel axle 43, so that the two driving wheels 45, 46 are normally free to rotate about the wheel axle 44. Accordingly, the present invention not only can prevent a child under 4 years old to operate the driving wheels 45, 46 to ignite the lighter, but also can avoid the lighter being accidentally ignited due to friction inside a user's pocket or carrier.

In order to ignite the safety disposable lighter of the present invention, the adult user is required to apply a sufficient depressing force downwardly on the at least one of the driving wheels 45, 46 (preferably depressing both driving wheel 45, 46 simultaneously), as shown in FIG. 3, until a lower engaging corner 454, 464 of each of the driving discs 451, 461 is engaged with the lower engaging corner edge 433 of the driven hole 432. Then, when the user rotates the driving wheels 45, 46, the respective driving surface 455, 465 (adjacent to the lower engaging corner 454, 464) of each of the driving discs 451, 461 of each of the driving wheel 45, 46 will press on the contacting driven surface 434 of the driven hole 432 of the striker wheel 43 and directly drive the striker wheel 43 to rotate in order to strike against the flint 42 to provide sparks towards the valve 12.

In view of preferred embodiment disclosed above, the engaging disc 441 is thinner than the striker wheel 43, so that it is easy to press the engaging disc 441 inside the driven hole 432 to firmly mount the engaging disc 441 at the center position of the striker wheel 43. Moreover, by equipping with the two driving wheel 45, 46, the two driving discs 451, 461 are inserted into the two ends of the driven hole 432 of the striker wheel 43 until in contact with the two sides of the engaging disc 441, so that the striker wheel 43 can be supported and retained in a position right above the flint 42. Besides, no additional part or element is needed to construct the present invention for performing the safety function, so that the manufacturing cost and assemble labors are minimized. Furthermore, according to the present invention, the igniting operation is more precise and easier in comparison with the conventional safety lighter because the driving wheels 45, 46 of the present invention is arranged to directly drive the striker wheel 43 to rotate.

What is claimed is:

1. A safety disposable lighter, comprising:

a supporting frame disposed on a gas reservoir having a valve which is actuated by a gas lever pivotally mounted on said supporting frame for actuating said valve to release gas within said gas reservoir therefrom, wherein said supporting frame comprises two supporting walls parallelly protruded on opposite sides of said gas lever; and an ignition means which comprises a flint supported by a resilient element at a position between said two supporting walls;

a striker wheel, which is rotatably mounted between said two supporting walls of said supporting frame, having an outer striking surface in contact with said flint which is retained urging against said striking surface of said striker wheel by means of said resilient element for generating sparks directed towards said valve when said striking surface is driven to rotate against said flint, wherein said striker wheel has an axial polygonal driven hole provided therethrough;

a wheel axle, which is rotatably mounted between said two supporting walls, having an enlarged central engaging disc fittedly mounted at a center position of said driven hole of said striker wheel so as to firmly support said striker wheel on top of said flint between said two supporting walls; and two driving wheels each having a polygonal driving disc integrally and coaxially protruded at an inner side thereof, each of said driving wheels having an axial hole provided therethrough, each of said axial holes having a diameter larger than a diameter of said wheel axle, wherein between said two supporting walls, said two driving wheels are rotatably mounted around two ends of said wheel axle respectively and said two driving discs of said two driving wheels are inserted into two end portions of said driven hole of said striker wheel respectively, wherein each of said driving wheels has a diameter larger than a diameter of said striker wheel, and said driving disc of each of said driving wheels has a size smaller than that of said driven hole;

whereby said two driving wheels are normally free to rotate about said wheel axle unless a sufficiently strong depressing force is applied to said two driving wheels to retain said two driving discs thereof engaging with said two end portions of said driven hole of said striker wheel, so that by rotating said two driving wheels with said depressing force, said two driving discs of said two driving wheels directly drive said striker wheel to rotate and strike against said flint to produce sparks towards said valve.

2. A safety disposable lighter, as recited in claim 1, wherein said polygonal driven hole of said striker wheel has a plurality of engaging corner edges and a plurality of driven surfaces, and each of said two polygonal driving discs of said two driving wheels also has a plurality of engaging corners and a plurality of driving surfaces.

3. A safety disposable lighter, as recited in claim 2, wherein said enlarged central engaging disc of said wheel axle is in circular shape and has a diameter equal to a distance between said two opposing driven surfaces of said polygonal driven hole, so that a circumferential surface of said engaging disc presses against said plurality of driven surfaces of said driven hole of said striker wheel so as to firmly and rotatably support said striker wheel between said two supporting walls by means of said wheel axle.

4. A safety disposable lighter, as recited in claim 1, wherein said driven hole of said striker wheel is in pentagonal shape to define five engaging corner edges and five driven surfaces.

5. A safety disposable lighter, as recited in claim 4, wherein said enlarged central engaging disc of said wheel axle is in circular shape and has a diameter equal to a distance between two opposing said driven surfaces of said pentagonal driven hole, so that a circumferential surface of said engaging disc presses against said five driven surfaces of said driven hole of said striker wheel so as to firmly and rotatably support said striker wheel between said two supporting walls by means of said wheel axle.

6. A safety disposable lighter, as recited in claim 1, wherein each of said two driving discs of said two driving wheels is in pentagonal shape and defines five engaging corners and five driving surfaces.

7. A safety disposable lighter, as recited in claim 2, wherein each of said two driving discs of said two driving wheels is in pentagonal shape and defines five engaging corners and five driving surfaces.

8. A safety disposable lighter, as recited in claim 3, wherein each of said two driving discs of said two driving wheels is in pentagonal shape and defines five engaging corners and five driving surfaces.

9. A safety disposable lighter, as recited in claim 4, wherein each of said two driving discs of said two driving wheels is in pentagonal shape and defines five engaging corners and five driving surfaces.

10. A safety disposable lighter, as recited in claim 5, wherein each of said two driving discs of said two driving wheels is in pentagonal shape and defines five engaging corners and five driving surfaces.

* * * * *